US005203139A

United States Patent [19]

Salsburg et al.

[11] Patent Number: 5,203,139

[45] Date of Patent: Apr. 20, 1993

[54] APPARATUS AND METHOD FOR WINDING AND WRAPPING ROLLS OF WEB MATERIAL

[75] Inventors: Frederic S. Salsburg, Victor; William E. Roberts, Fairport, both of N.Y.

[73] Assignee: Eastman Kodak Company, Rochester, N.Y.

[21] Appl. No.: 722,780

[22] Filed: Jun. 28, 1991

[51] Int. Cl.[5] ..... B65B 11/04

[52] U.S. Cl. ..... 53/430; 53/441; 53/465; 53/118; 53/556; 53/587

[58] Field of Search ..... 53/399, 430, 441, 118, 53/556, 587, 588, 389.2, 465

[56] References Cited

U.S. PATENT DOCUMENTS

| | | | |
|---|---|---|---|
| 602,150 | 4/1898 | Ball . | |
| 1,870,399 | 8/1932 | Butler et al. . | |
| 3,431,696 | 3/1969 | Horberg | 53/430 |
| 3,863,425 | 2/1975 | Edwards et al. . | |
| 3,928,939 | 12/1975 | Edwards et al. . | |
| 3,975,883 | 8/1976 | Besnyo | 53/430 |
| 4,095,395 | 6/1978 | Goldstein . | |
| 4,173,108 | 11/1979 | Eglinton et al. | 53/587 |
| 4,281,500 | 8/1981 | Mueller et al. | 53/211 |
| 4,409,776 | 10/1983 | Usoi | 53/399 |
| 4,827,700 | 5/1989 | Rampe et al. | 53/587 |
| 4,840,006 | 6/1989 | Humphrey | 53/64 |
| 4,909,880 | 3/1990 | Kittelson et al. | 156/189 |
| 4,912,911 | 4/1990 | Down | 53/465 |
| 5,046,298 | 9/1991 | Norkoski | 53/399 |

FOREIGN PATENT DOCUMENTS

| | | | |
|---|---|---|---|
| 32140 | 7/1981 | European Pat. Off. | 53/588 |

*Primary Examiner*—John Sipos
*Attorney, Agent, or Firm*—Charles E. Snee, III

[57] ABSTRACT

An improved apparatus and method are disclosed for winding and wrapping rolls of web material or other objects, in which the roll (10) is wrapped prior to removal from the turret winding machine (96). A roll (16) of stretch wrap material is traversed, swiveled and tilted beside the rotating roll (10) or other object to be wrapped under the control of a traverse motor (144), swivel motor (178) and tilt motor (192) which are actuated in proportion to the speed of rotation of roll (10). For improved accuracy of wrapping, roll (16) of wrap material preferably is located along the swivel axis of the apparatus.

15 Claims, 9 Drawing Sheets

APPARATUS AND METHOD FOR WINDING AND WRAPPING ROLLS OF WEB MATERIAL

DESCRIPTION

1. Technical Field

This invention concerns apparatus and methods for winding and wrapping rolls of web material. More particularly, the invention is related to such apparatus and methods in which a roll of web material or a more or less cylindrical body is spirally wrapped with a continuous length of stretch wrap material about its side surface, the wrap material also extending across overlapping sectors of the end surfaces of the body; so that, the surface of the body is essentially completely covered by two or more layers of the wrap material. The apparatus and method of the invention are especially suited for winding sensitized web materials such as photographic films and papers and then wrapping the rolls with a stretch wrap material which may be light or moisture tight or both.

2. Background Art

A variety of apparatus and methods have been developed for wrapping or packaging elongated cylindrical objects and the like. For example, U.S. Pat. No. 602,150 shows a press for forming cylindrical bales of cotton and then wrapping the sides of the bales with a spiral cover of paper, leaving the ends of the bale exposed. U.S. Pat. No. 1,870,399 shows a packaging apparatus and method in which products enclosed within a convoluted paper wrapper are held in place by a spirally applied tape, after which the end portions of the wrapper are manually folded over and taped in place. U.S. Pat. Nos. 3,863,425 and 3,928,939 show an apparatus for wrapping elongated cylindrical objects in which a thermoplastic wrapper is applied spirally along the length of the object and convolutely at the ends, after which the wrap material is heat shrunk onto the object.

U.S. Pat. No. 4,095,395 shows a self-guiding stretch-wrap machine in which a vehicle carrying a roll of wrap material is caused to move around the object to be wrapped while the roll is raised and lowered to direct wrap material to the side surfaces of the object. U.S. Pat. No. 4,173,108 discloses an apparatus for wrapping carpet rolls in which the rolls of carpet are rotated about a horizontal axis to draw wrap material from a roll which traverses along the length of the carpet. U.S. Pat. No. 4,281,500 shows a wrapping apparatus in which a large roll is rotated end for end about an axis perpendicular to the axis of the roll; so that, stretch wrap from a stationary roll is wrapped over the side surfaces and ends of the roll.

U.S. Pat. No. 4,827,700 shows a method and apparatus for wrapping round bales in which the bale is rotated about its axis while a roll of stretch wrap is swung in an arc along its length. U.S. Pat. No. 4,840,006 shows a stretch wrapping machine including a pretensioner for the wrap material and means for applying variable braking force to maintain desired velocity ratios between supply and driven rollers. U.S. Pat. No. 4,909,880 shows a method and apparatus for tape winding irregular shapes in which the shapes are rotated while a source of tape is traversed back and forth along their lengths. U.S. Pat. No. 4,912,911 shows an apparatus for stretch wrapping rolls of paper in which the roll is rotated about its horizontal axis while a wrapping head passes stretch wrap material end to end about the roll.

Applicants also are aware of an apparatus used for wrapping rolls of light sensitive web material such as photographic paper, which operates in accordance with the schematic diagrams of FIGS. 1 to 4 and is illustrated schematically in FIGS. 5 and 6. In this known apparatus, a roll 10 of web material is removed from the web winding machine, not illustrated. Then, as shown schematically in FIG. 1, roll 10 is mounted on stub axles 12 and 14 for rotation by a motor, also not illustrated. Stub axles 12,14 are of the known type which can be extended into and retracted from the ends of a hollow core on which roll 10 is wound. A roll 16 of stretch wrap material such as a light impervious black plastic is positioned by the apparatus of FIGS. 5 and 6 near roll 10 and a lead end 18 of the wrap material is attached to the side surface of roll 10 by means such as strips 20 of tape. Roll 10 is then rotated so that its lower edge, as viewed in FIG. 1, moves into the plane of the figure. While roll 10 is rotating, roll 16 is traversed horizontally toward the left end of roll 10, as viewed in FIG. 1, and at an appropriate time is swivelled about an axis perpendicular to the plane of the figure, as shown schematically in FIG. 2; so that, the wrap material is applied in a spiral to a portion of the side surface of roll 10. When its horizontal traverse brings it beyond the end surface of roll 10, roll 16 also may be tilted about an axis in the plane of the figure and perpendicular to the axis of rotation of roll 16; so that, the wrap material is stretched over a chordal sector of the end surface of roll 10 as shown schematically in FIG. 3. At this point, the direction of traverse of roll 16 is reversed and the direction of swivel and tilt are reversed during the traverse; so that, the wrap material is applied in an oppositely running spiral to a further portion of the side surface of roll 10. At the other end of roll 10, another chordal sector of the end surface is covered. This process is repeated until the entire side surface of roll 10 has been covered and both end surfaces have been covered right down to stub axles 12,14. At this point, rolls 10 and 16 are stopped, the wrap material is cut and strips 22 of tape are used to secure the tail end 24 of the wrap material to the completely wrapped roll, as shown schematically in FIG. 4.

The apparatus for producing a wrapped roll in the manner just described is illustrated schematically in FIGS. 5 and 6. Roll 10 is brought from the winder and mounted in a support frame 26 which comprises a motor, not illustrated, for rotating the roll. Adjacent to support frame 26 is provided a wrapper support frame comprising at least two pairs of vertical posts 28 joined at their upper ends by a pair of horizontal box beams 30. On the upper surfaces of beams 30 are provided a pair of parallel rails 32 which support a wrapping apparatus 34 for movement toward and away from roll 10. The carriage for apparatus 34 comprises a pair of box frame members 36 mounted around beams 30. Within frame members 36 are mounted suitable wheels 38 which ride on rails 32. Rigidly attached between frame members 36 are a pair of horizontal box beams 40. Near their centers as shown in FIG. 5, beams 40 are bridged by a short box beam 42 which supports an engagement motor 44 and transmission 46 which are operatively connected to a pair of horizontal, concentric drive shafts 48 which extend parallel to beams 40. At their opposite ends, shafts 48 are connected to transmissions 50 mounted on the outer sides of frame members 36. The output shafts of transmissions 50 extend into the interior of frame members 36 and support drive pinions 52 which mesh with gear racks 54 mounted on the outer sides of beams 30. Thus, operation of motor 44 causes the carriage for apparatus 34 to move toward or away from engagement with roll 10.

On their facing sides, beams 40 each support a horizontal rail 56 which extends substantially all the way across the space between beams 30. Between rails 56 is mounted a traverse carriage frame 58 provided with suitable wheels 60 for engaging rails 56 as shown schematically in FIG. 5. On the upper surface of frame 58 are mounted a traverse motor 62 and transmission 64 which are operatively connected to a pinion 66 which engages a gear rack, not illustrated, mounted above one of rails 56. Thus, operation of motor 62 causes carriage frame 58 to traverse from side to side on rails 56. On the under side of carriage frame 58 is mounted one side of a swivel bearing 68, the other side of the bearing being mounted to a wrapper support frame 70. Extending essentially vertically downward from carriage frame 58 is a fixed swivel post 72, illustrated in phantom, which travels with carriage frame 58 but does not rotate. Mounted on wrapper support frame 70 are a swivel motor 74 and transmission 76, which are operatively connected to a pinion, not illustrated, which meshes with a gear, also not illustrated, supported by swivel post 72. Thus, operation of motor 74 causes wrapper support frame 70 to swivel about the axis of swivel bearing 68 and swivel post 72.

Wrapper support frame 70 is attached to a pair of downwardly depending legs 78,80 joined at their lower ends by a frame member 82. Between legs 78,80 is mounted a wrapper head support frame 84. Frame 84 also is mounted for movement vertically between legs 78,80 by means not illustrated. On the side of frame 84 opposite roll 10 is mounted a motor 86 connected via a suitable transmission, not illustrated, to an essentially horizontal output shaft 88 which passes through frame 84 approximately in the plane of the centerline of roll 16. On the other side of frame 84 is mounted one side of a tilt bearing 90 which is concentric with shaft 88, the other side of tilt bearing 90 being mounted to a wrapper head 92. Thus, operation of motor 86 causes wrapper head 92 to tilt about the axis of shaft 88. Wrapper head 92 comprises a suitable frame for rotatably supporting roll 16 of stretch wrap material at a location well in front of the axis of swivel bearing 68 and swivel post 72. The web of wrap material is drawn from roll 16 over a pair of differentially driven prestretch rollers 94 and a tension sensing roller 96 and is attached to the underside of roll 10 at the beginning of the wrapping sequence, as previously discussed.

A variety of problems have been experienced with the apparatus shown in FIGS. 5 and 6. Because each roll 10 is wound at a location removed from the wrapper, it is necessary to remove each roll from its winder and then transport it on a suitable carrier for installation on support frame 26. As a result, the winder must idle while the roll is removed for transfer to the wrapper and the exterior convolutions of the roll can be damaged during transfer. Moreover, the requirement to move the roll from the winder to the wrapper slows the overall process considerably. When the web material on roll 10 is light sensitive, this slow process prolongs the period in which the roll must be handled in the dark where damage to the roll is more likely to occur.

Because of the position of roll 16 well in front of the axes of swivel bearing 68 and swivel post 72, as shown in FIG. 5, rather small variations in the positioning accuracy of swivel motor 74 can produce unacceptably large variations in the position of roll 16 during wrapping which may cause improper application of the wrap material. The positioning of roll 16 well in front of these axes also increases the over all size of the apparatus, which then requires a larger space for its operation. Similarly, because the axis of roll 16 is approximately coplanar with the axis of shaft 88, rather small variations in the positioning accuracy of tilt motor 86 can produce rather large variations in the positions of the ends of roll 16 which may cause improper application of the wrap material.

SUMMARY OF THE INVENTION

The primary objective of this invention is to provide an improved apparatus for wrapping objects such as rolls of web material in which the rolls can be wrapped while still mounted on the roll winder, thereby eliminating the need to transport the roll from the winder to the wrapper.

A further objective of this invention is to provide such an apparatus in which the roll of wrap material can be more accurately positioned during wrapping to ensure optimum coverage of the object.

Yet another objective of this invention is to provide a more compact apparatus for wrapping which will require a smaller operating space.

Still another objective of this invention is to provide such an apparatus in which wrapping proceeds as a function of the speed of rotation and diameter of the object.

These objectives are given only by way of illustrative examples; thus other desirable objectives and advantages inherently achieved by the disclosed invention may occur or become apparent to those skilled in the art. Nonetheless, the scope of the invention is to be limited only by the appended claims.

In accordance with one embodiment of the invention, an apparatus is provided for winding and stretch wrapping rolls of web material. Such apparatus comprises a rotatable turret assembly and a plurality of first means, mounted at circumferentially spaced locations on the turret assembly, for independently supporting and rotating at each location a core on which such web material is to be or has already been wound. Positioned in proximity to the turret assembly is a machine according to the invention for applying a stretch wrap to a first roll supported and rotated by one of such first means. Operatively connected to the turret assembly and the first and second means is a controller means for causing a first roll to be wound by one of the first means, thereafter rotating the turret assembly to position the first roll for stretch wrapping by the second means and to position an empty core for winding of a second roll at another of the first means, and thereafter wrapping the first roll while winding the second roll.

The controller means may comprise an encoder for signalling the speed of rotation of the first roll during stretch wrapping and one or more motors operatively connected to the encoder for controlling operation of the wrapping machine. The wrapping machine may comprise a roll of stretch wrap material having a longitudinal axis; means for supporting the roll of wrap material for rotation about its axis; means for traversing the roll of wrap material along a path substantially parallel to the axis of rotation of the first roll being wrapped; means for moving the roll of wrap material about a swivel axis substantially perpendicular to such path; means for moving the roll of wrap material about a tilt axis substantially perpendicular to such swivel axis, whereby the wrap material can be applied in a spiral pattern around the cylindrical surface and across the ends of the first roll while the first roll is rotated about its axis of rotation and roll of wrap material is moved along such path, about such swivel axis and about such tilt axis. The controller means may further comprise first means for traversing the roll of wrap material at a speed preferably proportional to the speed of rotation of the roll being wrapped. Second means are provided for swivelling the roll of wrap material at preselected positions along such path and, optionally, at a speed proportional to such speed of rotation. Third means are provided for tilting the roll of wrap material at preselected positions along such path and, again optionally, at a speed proportional to such speed of rotation.

In accordance with the method of the invention, one roll of web material can be wound while a previously wound roll simultaneously is wrapped by providing a rotatable turret assembly having a plurality of first means, mounted at circumferentially spaced locations on the turret assembly, for independently supporting and rotating at each location a core on which such web material is to be or has already been wound; and providing second means, positioned in proximity to the turret assembly, for applying a wrap material to a first roll supported and rotated by one of such first means. A first roll of such web material is then wound on one of such first means; the turret assembly is rotated to position the first roll at the second means and to position a core for winding of a second roll on another of said first means. Then wrap material is applied to the first roll while rotating the first roll with the one of the first means; and the second roll at least partially simultaneously is wound on the other of the first means.

Another embodiment of the apparatus of the invention is particularly suited for wrapping a body having a side surface extending between end surfaces, the apparatus being of the type including means for supporting and rotating such body about a first longitudinal axis thereof, a roll of stretch wrap material having a second longitudinal axis, means for supporting such roll of wrap material for rotation about its longitudinal axis, means for traversing the roll of wrap material along a path substantially parallel to the first longitudinal axis, means for moving the roll of wrap material about a swivel axis substantially perpendicular to such path and means for moving the roll of wrap material about a tilt axis substantially perpendicular to the swivel axis, whereby the wrap material can be applied in a spiral pattern around the side surface and across the end surfaces while the body is rotated about the first longitudinal axis and the roll of wrap material is moved along the path, about the swivel axis and about the tilt axis. The improvement according to this embodiment of the invention comprises a swivel bearing having a swivel axis; first means for mounting one race of the swivel bearing to the means for traversing; a frame member; second means for mounting the other race of the swivel bearing to the frame member; third means for mounting the means for supporting on the frame member to position the roll of wrap material along the swivel axis opposite the swivel bearing; and the means for moving about the swivel axis being operatively connected to rotate the frame member on the swivel bearing about the swivel axis. In one actual embodiment, the inner race of the swivel bearing is mounted to the means for traversing; the outer race of the swivel bearing is mounted to the frame member; and the means for moving about the swivel axis comprises a gear ring or sector mounted to the frame member, a pinion gear engaged with the gear ring or sector and means mounted on the means for traversing for rotating the pinion gear.

BRIEF DESCRIPTION OF THE DRAWINGS

The foregoing and other objectives, features and advantages of the invention will be apparent from the following more particular description of the preferred embodiments of the invention, as illustrated in the accompanying drawings.

DESCRIPTION OF THE PREFERRED EMBODIMENTS

Figure 1:
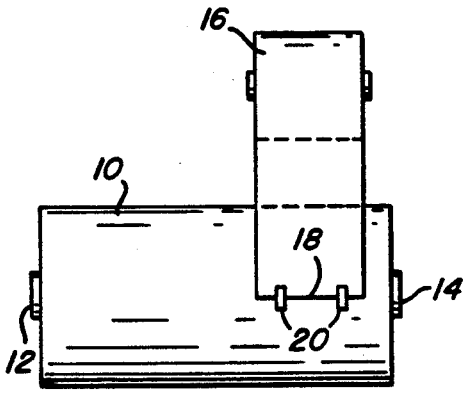
FIGS. 1 to 4 illustrate schematically how the roll of stretch wrap material is moved relative to the object being wrapped in accordance with a prior art wrapping process.
Figure 2:
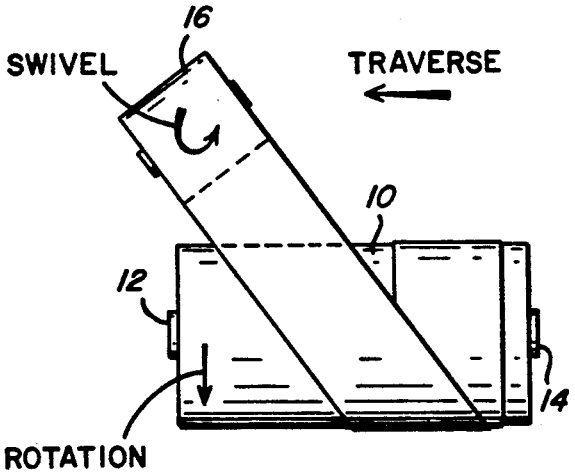
Figure 3:
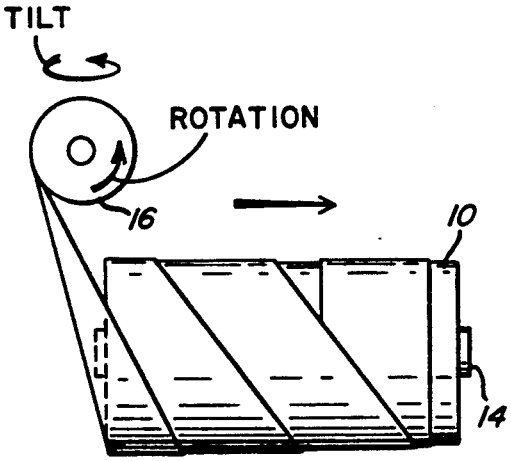
Figure 4:
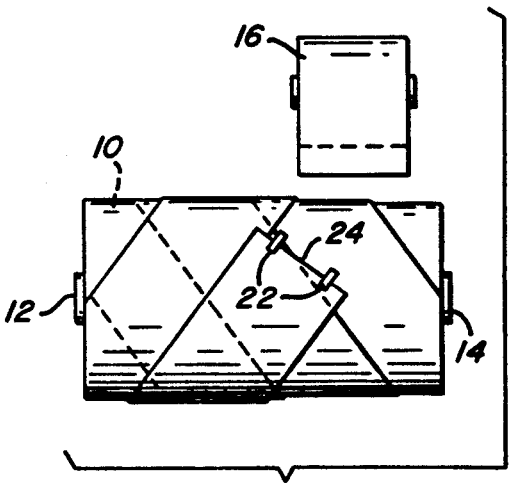
Figure 5:
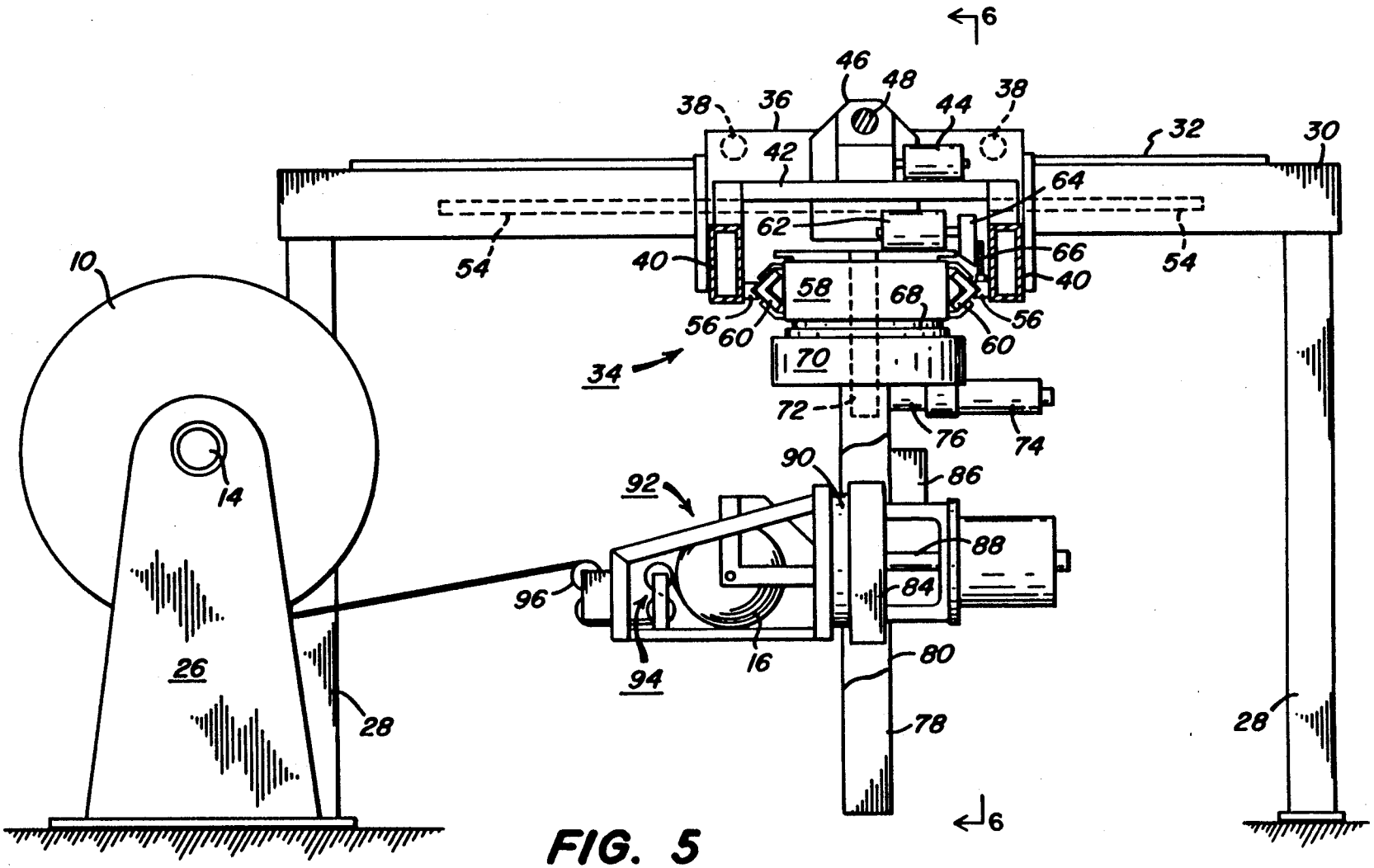
FIG. 5 (PRIOR ART)
FIG. 5 shows a side elevation view of a prior art apparatus which operates in accordance with the process illustrated in FIGS. 1 to 4.
Figure 6:
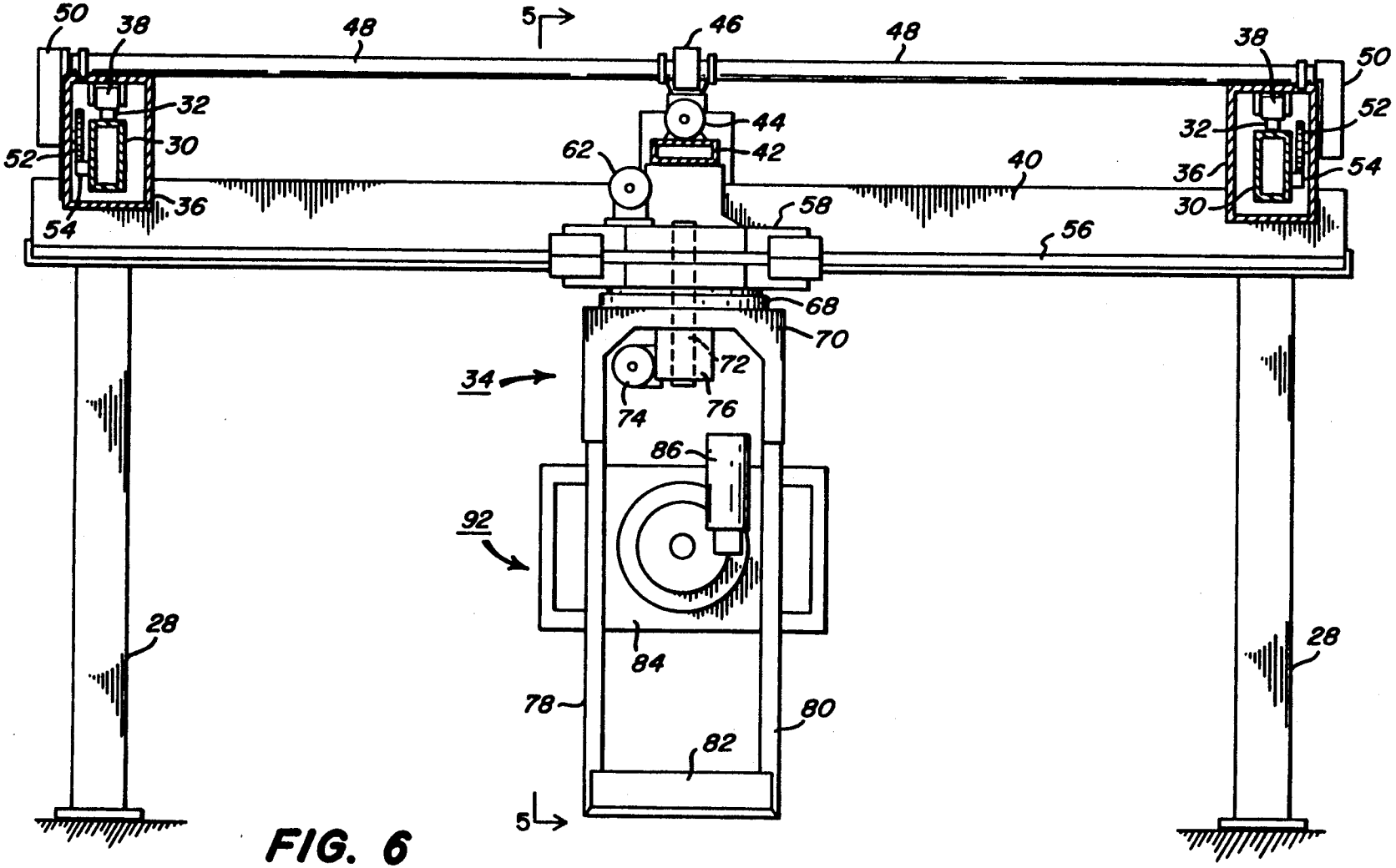
FIG. 6 (PRIOR ART)
FIG. 6 shows a view taken along line 6—6 of FIG. 5.

The following is a detailed description of the preferred embodiments of the invention, reference being made to the drawings in which the same reference numerals identify the same elements of structure in each of the several Figures.

Figure 7:
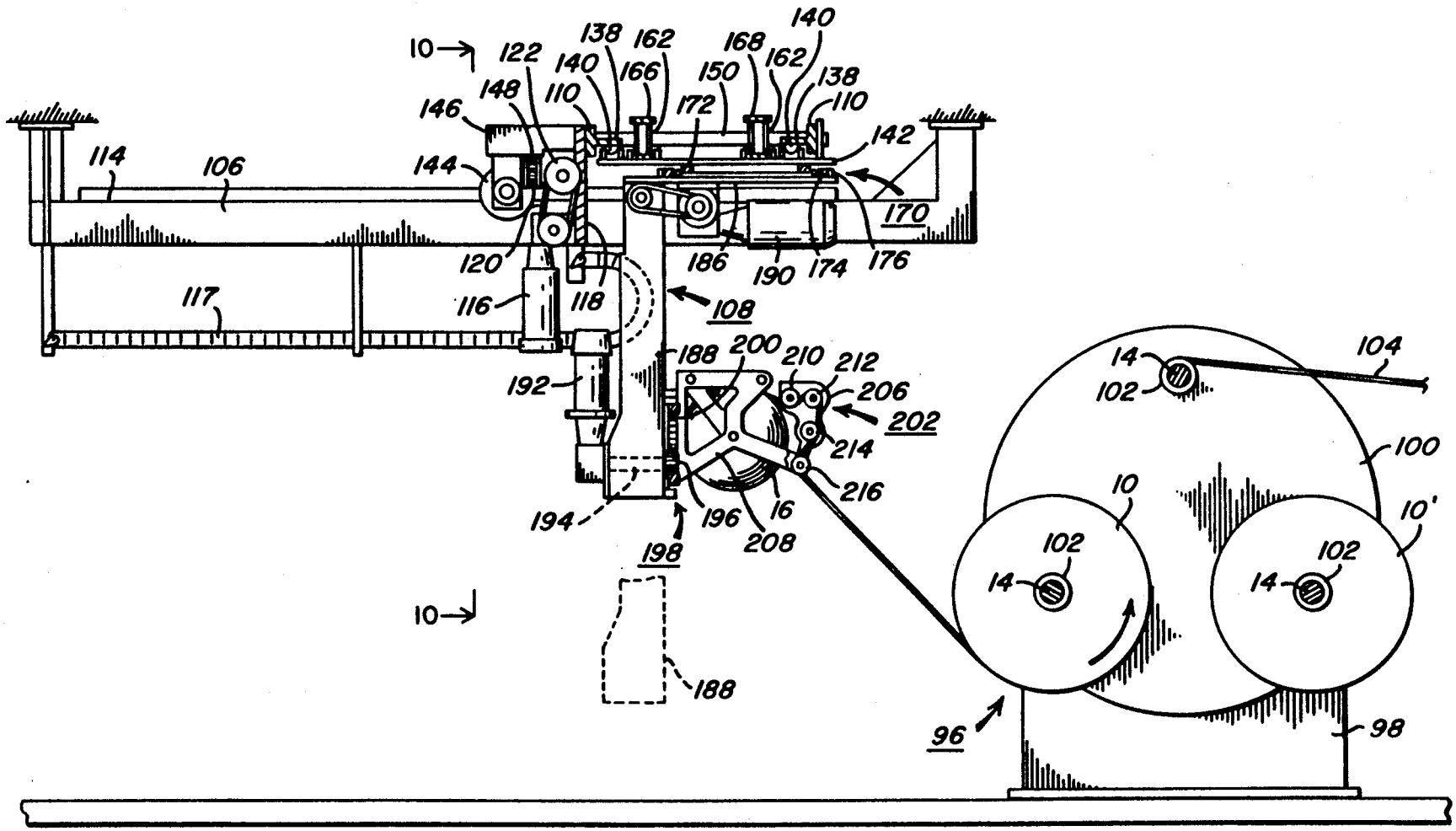
FIG. 7 shows a side elevation view of the apparatus according to the present invention, indicating the relationship between the wrapper and the turret winder, the winder being viewed along line 7—7 of FIG. 8.
Figure 8:
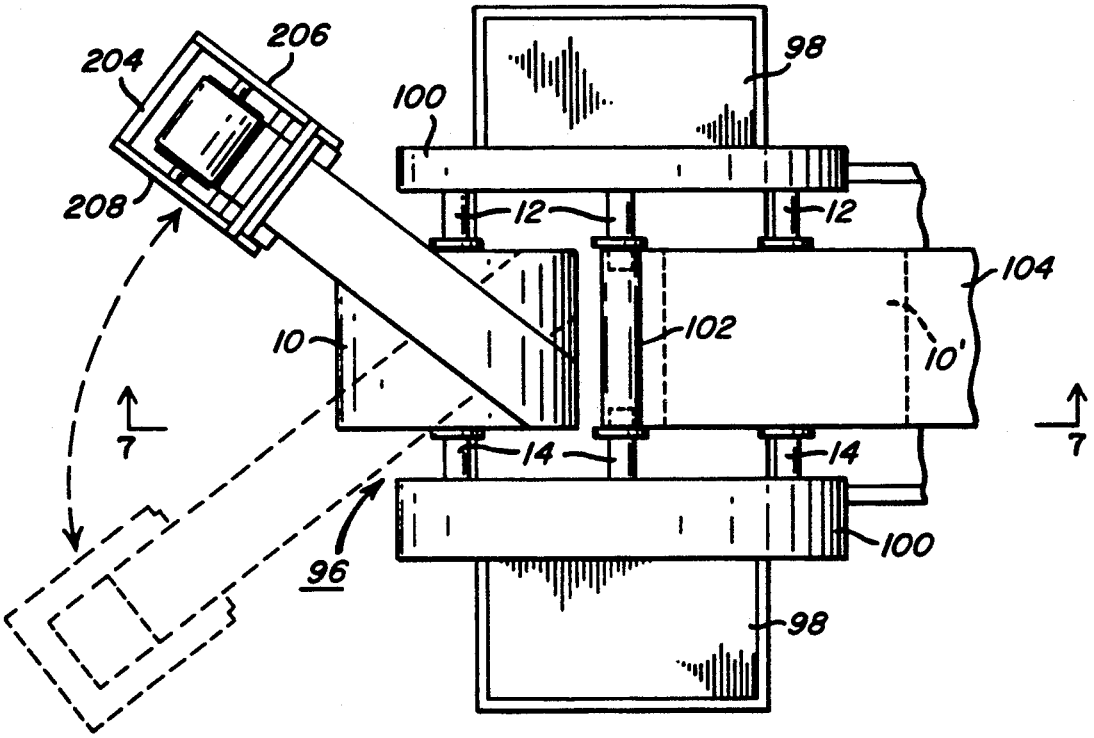
FIG. 8 shows a partial top view of the apparatus of FIG. 7, indicating how the wrapper head moves relative to the turret winder.

Referring to FIGS. 7 and 8, a turret winder 96 is illustrated which comprises a frame 98 which rotatably supports a pair of coaxially aligned, axially spaced turret wheels 100 for rotation by a suitable motor, not illustrated. Mounted equidistantly around the turret wheels are a plurality of stub axle pairs 12,14 which in the known manner can be moved axially toward or way from each other to extend into or retract from a hollow core 102 for a roll 10 of web material. In a prior art application of such a turret winder, an indeterminate length 104 of web material would be wound onto one of cores 102 by means of a motor for rotating the associated stub axles 12,14. The previously wound roll 10' would have been moved downward by rotating turret wheels 100 and the next previously wound roll 10 would have been moved around to the other side of the turret where it could be conveniently removed while length 104 was being wound. In accordance with the present invention, the stub axles for the next previously wound roll 10 can be rotated by a motor, not illustrated, to permit roll 10 to be wrapped prior to its removal from turret winder 96, while a new roll is being wound from length 104.

As shown in FIGS. 7 to 10, the apparatus according to the invention comprises a pair of horizontal, parallel box beams 106 which conveniently may be suspended from the overhead structure of the enclosure for the apparatus; so that, beams 106 extend essentially on either side of turret winder 96. The wrapping mechanism 108 is mounted on beams 106 by means of a carriage comprising a pair of horizontal, parallel box beams 110 which extend between beams 106 and are joined at their ends by frame members 112, to form a rectangular carriage frame. Beneath frame members 112 at each corner of the carriage frame, the frame is supported by suitable wheels, not illustrated, which ride on an elongated track surface 114 on the upper side of each beam 106. To move wrapping mechanism 108 toward and away from turret winder 96, a servo motor 116 is mounted on a bracket 118 which extends downwardly from about the center of the side of the carriage frame opposite to turret winder 96. Motor 116 drives a timing belt 120 which engages a pulley on a drive shaft 122 rotatably supported on the carriage frame by bearing blocks 124, 126 and 128. On the outboard ends of shaft 122 are mounted pinions 130 and 132 which are engaged respectively with gear racks 134 and 136 mounted adjacent to track surface 114 on each beam 106. Power cabling for motor 116 is run through a flexible guide 117 suspended from box beam 106 as shown schematically in FIG. 7. Thus, operation of motor 116 causes the carriage frame to move toward or away from turret winder 96.

Figure 9:
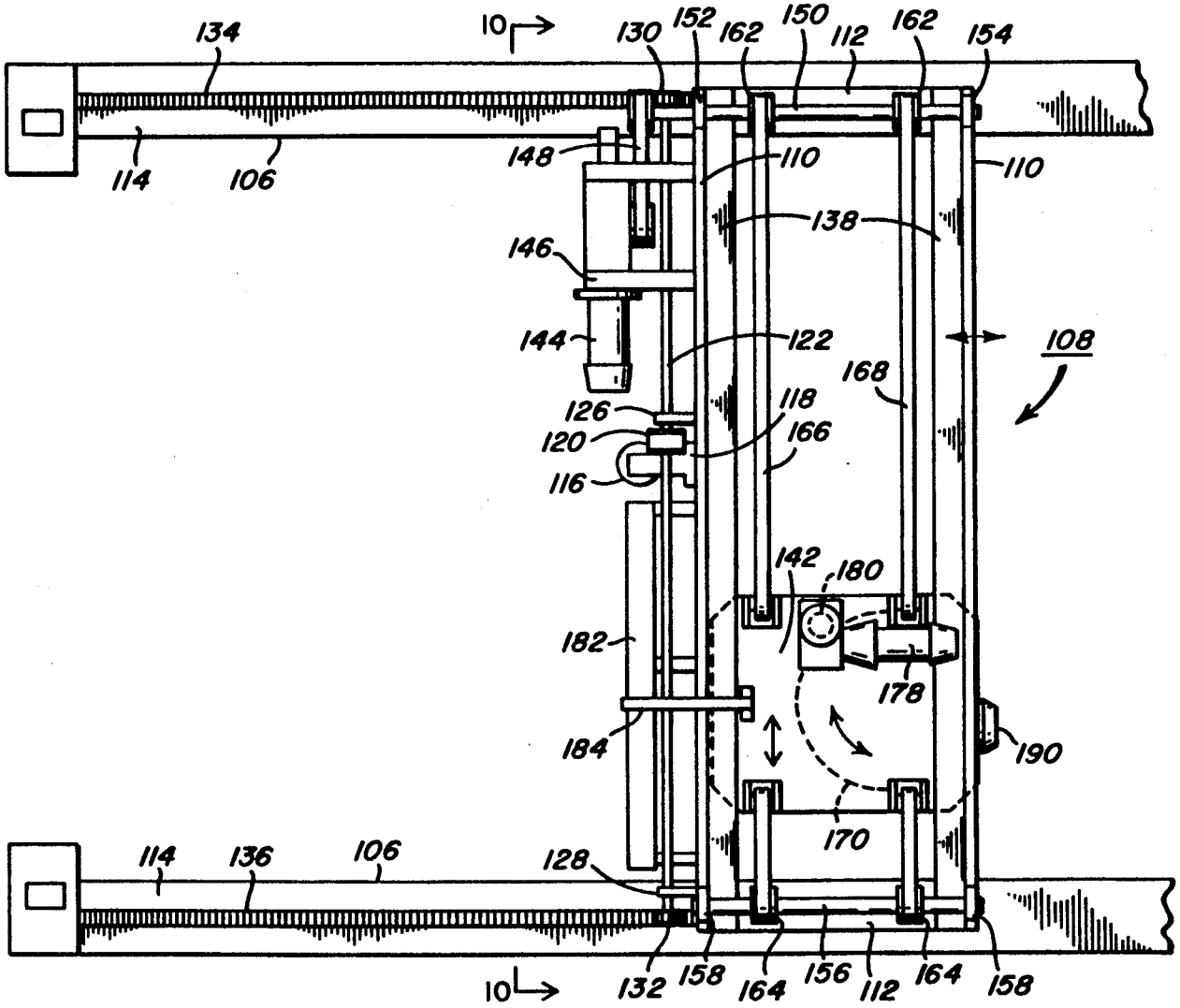
FIG. 9 shows a top view of the apparatus of FIG. 7.

As shown in FIG. 7, each box beam 110 is rigidly attached to a horizontally extending plate 138 on the underside of which is mounted a horizontally extending traverse track 140. Suspended from and between traverse tracks 140 is a traverse carriage plate 142. A servo motor 144 is mounted on a bracket 146 which extends laterally from one of box beams 110. Motor 144 drives a timing belt 148 which engages a pulley on a drive shaft 150 rotatably supported on the carriage frame by bearing blocks 152 and 154. At the opposite end of the carriage frame as shown in FIG. 9, an idler shaft 156 is rotatably supported on the carriage frame by bearing blocks 158 and 160. Pairs of timing pulleys 162 and 164 are mounted on shafts 150 and 156. Lengths 166 and 168 of timing belt are attached at their ends to opposite sides of traverse carriage plate 142 and wrapped around respective sets of timing pulleys 162,164. Thus, operation of motor 144 causes drive shaft 150 to rotate which applies tension to belt lengths 166,168 and causes traverse carriage plate 142 to traverse from side to side on tracks 140.

As shown in FIG. 7, suspended beneath traverse carriage plate 142 is a large diameter swivel bearing 170 comprising an inner race 172 attached to the underside of plate 142 and an outer race 174. Attached to the outer periphery of race 174 is a bull gear ring or gear sector 176. Mounted on the upper side of traverse carriage plate 142 is a motor 178 having an output shaft which extends vertically down through plate 142 and supports at its lower end a pinion gear 180 which meshes with gear ring or sector 176, as shown in phantom in FIG. 9. Power cabling for motor 178 is run through a flexible guide 182 suspended from box beam 110 and from a bracket 184 which extends over box beam 110 from traverse carriage plate 142, as shown schematically in FIGS. 9 and 10. Thus, operation of motor 178 causes pinion gear 180 to rotate gear ring 176. The diameter of gear ring or sector 176 preferably is as large as practical given the available space; so that, any small positioning inaccuracies of motor 178 will produce still smaller inaccuracies at the swivel axis. Outer race 174 and gear ring or sector 176 are mounted on a support plate 186. As seen in FIG. 7, a portion of support plate 186 extends well beyond the diameter of gear ring or sector 176 on the side opposite to turret winder 96 and supports a downwardly extending, telescopic mast 188 of conventional design. A motor 190 is mounted on the underside of support plate 186 and operatively connected to mast 188 for extending its length from that shown in FIG. 7 to a lower position, shown fragmentarily in phantom.

Near the lower end of mast 188 is mounted a motor 192 whose horizontal drive shaft 194, illustrated in phantom, extends through the mast and supports at its end a pinion gear 196. The outer race of a rather large diameter tilt bearing 198 is attached to the lower end of mast 188. Bearing 198 surrounds and is provided on the inner diameter of its inner race with a similarly large diameter gear ring or gear sector 200 which meshes with pinion gear 196. Mounted on the inner race of bearing 198 is a wrapper head assembly 202 which supports roll 16 of wrap material. Thus, operation of motor 192 causes pinion gear 196 to rotate the inner race of bearing 198 which causes wrapper head assembly 202 to tilt about a horizontal axis. As in the case of the swivel drive, the large diameter of gear ring or sector 200 helps ensure that any positioning inaccuracies of motor 192 will be still smaller at the tilt axis of bearing 198.

Figure 10:
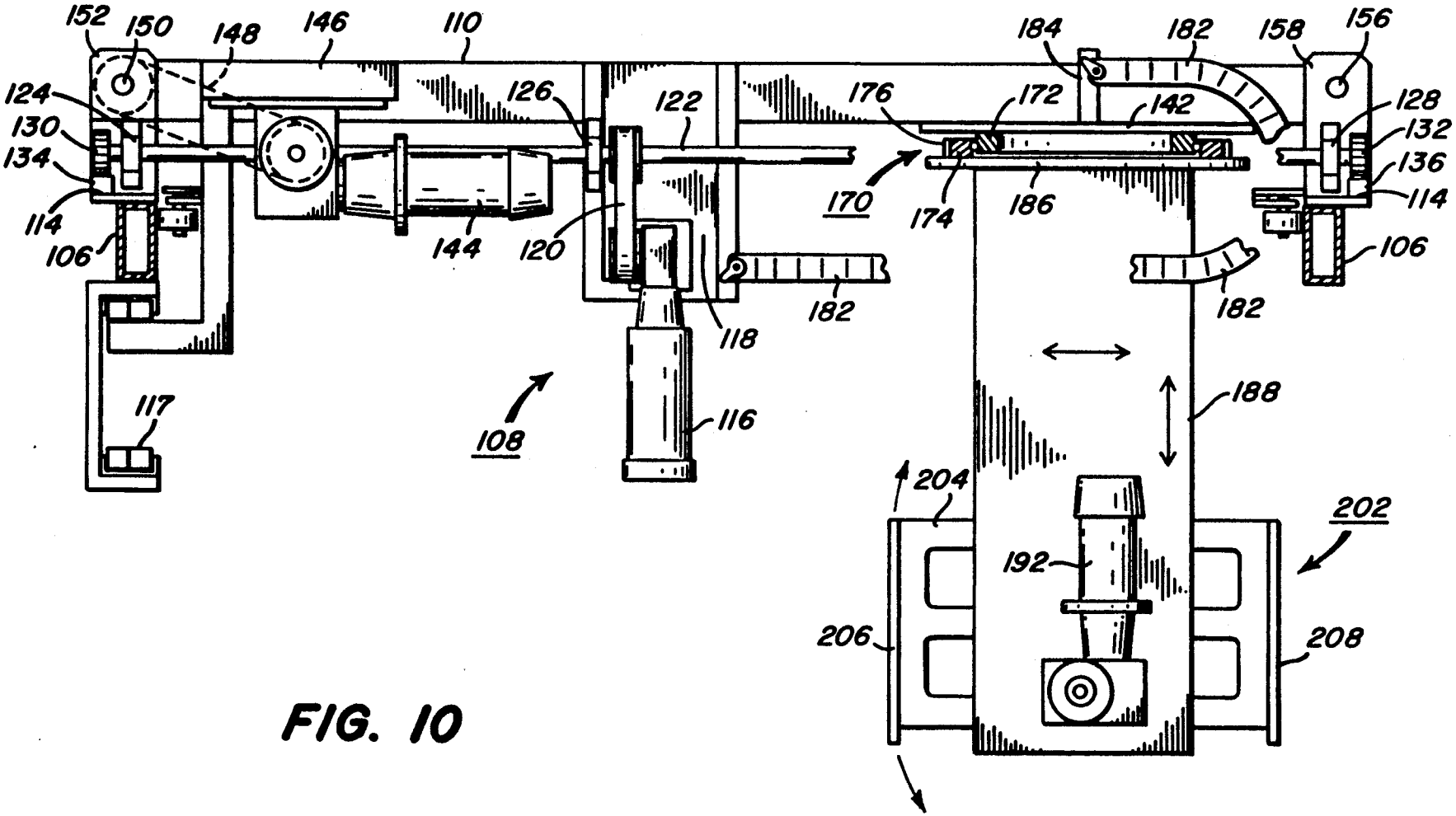
FIG. 10 shows a view taken along line 10—10 of FIGS. 7 and 9.

As shown schematically in FIGS. 7, 8 and 10, wrapper head assembly 202 comprises a back plate 204 rigidly mounted to the inner race of tilt bearing 198. A pair of side plates 206 and 208 are rigidly mounted to the vertical edges of back plate 204 and extend toward turret winder 96. Between side plates 206,208, roll 16 of wrap material is supported for rotation on a suitable axle. In accordance with the present invention, the diameter of gear ring 176 preferably is as large as practical, as previously indicated. To further reduce the magnitude of positioning errors of roll 16 during swivelling, roll 16 should be positioned along the axis of and beneath or opposite to swivel bearing 170; so that, the axis of the bearing extends close to, and preferably intersects with, the axis of roll 16. Thus, as is apparent from FIG. 7, the axis of swivel bearing 170 passes through roll 16. In FIG. 7, side plate 208 has been broken away at the right, as illustrated, to reveal the rollers supported between the side plates. As the web of wrapper material is drawn from roll 16, it passes part way around the underside of a friction driven roller 210 supported between side plates 206,208 and then part way around the upper side of a roller 212; so that, an initial stretch is applied to the wrap material. Preferably, roller 210 is friction driven by the web as it passes; whereas, roller 212 is gear driven from roller 210 at a slightly higher speed. From roller 212, the web is drawn over a tension sensing roller 214 which may be used to monitor the tension in the web just before it leaves wrapper head assembly 202. Finally, the web passes part way around an idler roller 216 and is drawn onto roll 10 which is rotating on turret winder 96.

Figure 11:
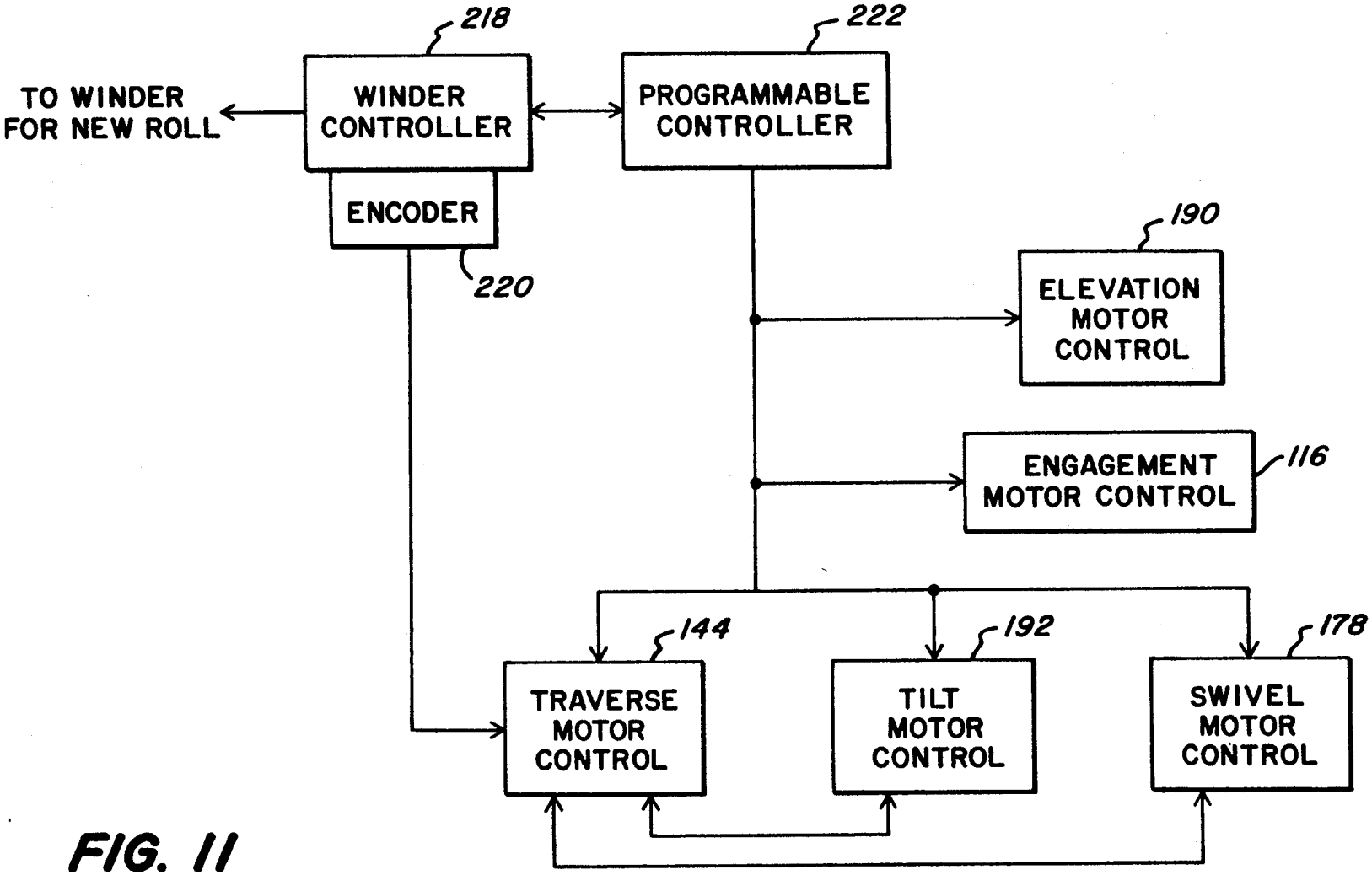
FIG. 11 shows a schematic diagram of the control system for the apparatus according to the present invention.

FIG. 11 shows a schematic diagram of the control system for the apparatus of the invention. A known type of winder controller 218 is provided for directing the operation of turret winder 96 to rotate stub axles 12,14 to wind each new roll from web 104, to rotate the turret when a new roll has been completed and to rotate each completed roll 10 during wrapping. For a roll 10 having a diameter of 20 to 54 inches (50.8 to 137.2 cm) and weighing as much as 4,000 pounds (1814 kg), a typical speed for roll 10 would be 5 rpm during wrapping. As each completed roll is rotated, an encoder 220 produces a signal indicating the total number of degrees of revolution of each completed roll after wrapping commences. This signal is fed to the controller for traverse motor 144 which causes traverse carriage plate 142 to traverse in one direction or the other at the appropriate times during revolution of roll 10. Preferably, the traverse speed is directly proportional to the angular velocity of roll 10; so that, the wrapper can follow the roll at various speeds. The controller for traverse motor 144 may be provided with separate programs for rolls 10 of different diameters and widths. Signals from the controller for motor 144 also are fed to the controller for tilt motor 192 and swivel motor 178 at the appropriate times for tilting or swivelling of roll 16 as wrapping progresses. Tilting and swivelling of roll 16 optionally may be completed at speeds proportional to the angular velocity and diameter of roll 10. Controllers 218, 144, 192 and 178 are under the supervisory control of a conventional programmable controller 222, which also controls elevation motor 190 and engagement motor 116.

Figure 12:
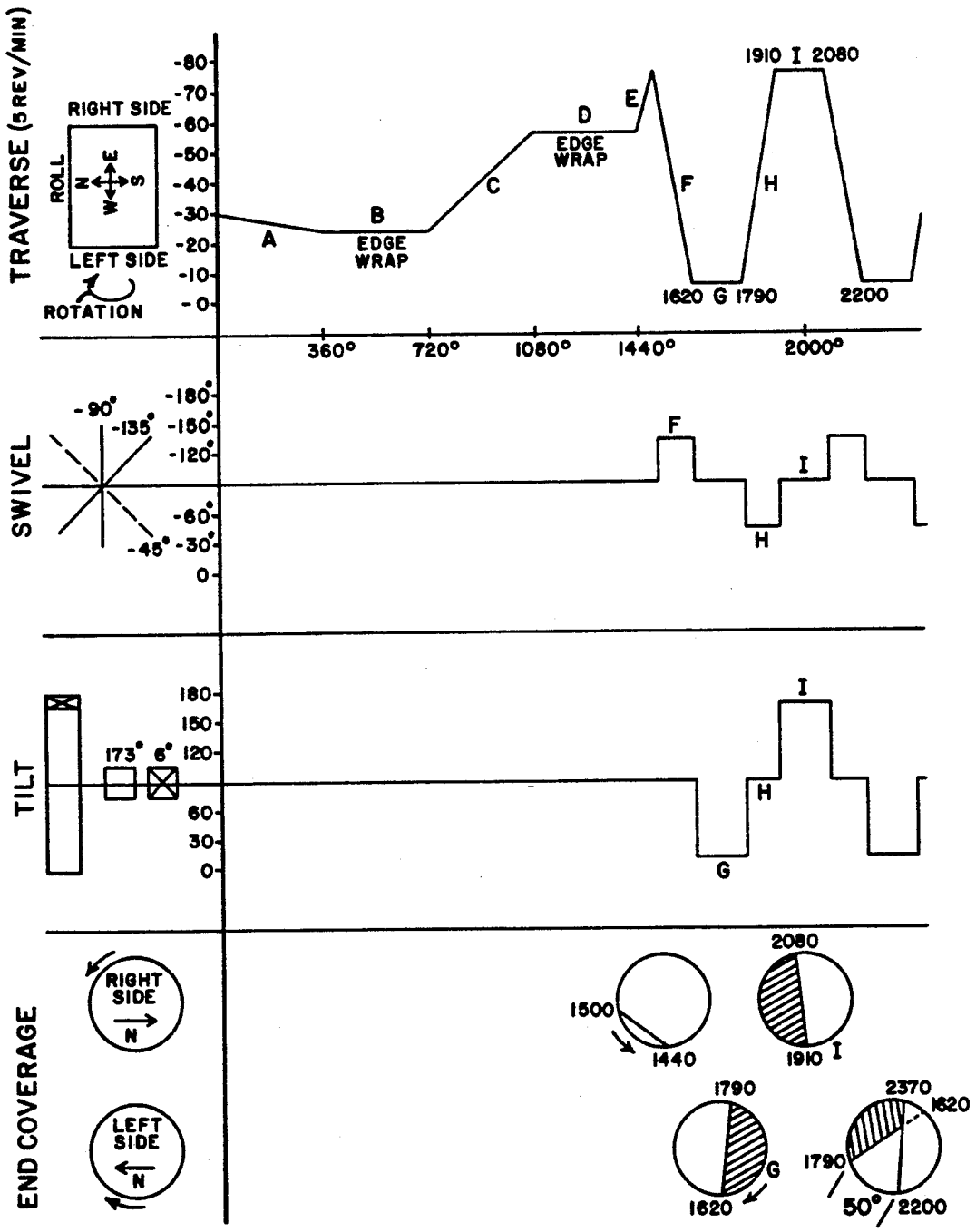
FIG. 12 shows a partial timing diagram for the operation of the apparatus according to the present invention.

FIG. 12 shows a partial timing diagram for the operation of the apparatus according to the invention. For a roll 10 approximately 40 inches (102 cm) in length, the center of roll 16 initially is positioned approximately 10 inches (25.4 cm) from the left end and the lead end of the wrap material is manually attached to the roll. Preferably, the width of the wrap material is 30 inches (76.2 cm) and the wrap material is a light impervious black plastic such as linear low density polyethylene, approximately 0.002 inches (0.00508 cm) in thickness. The operator then activates controller 222 which starts rotation of roll 10 at 5 rpm. Meantime, a new roll is being wound on turret winder 96. The traverse drive moves wrapper head assembly 202 to the left end at a speed of approximately 0.0417 ft/sec (0.127 m/sec) during part A of the cycle, the first 360° of rotation of roll 10 and then dwells to apply a protective, convoluted edge wrap at the left end during part B of the cycle, the next 360°. That is, the edge of the wrapper material comes just to the left end of roll 10. During part C of the cycle, from 720° to 1080°, the wrapper head assembly traverses to the right end of the roll at 0.222 ft/sec (0.0678 m/sec) and then dwells again to apply a protective, convoluted edge wrap at the right end during part D of the cycle, the next 360°. During part E of the cycle, from 1440° to 1500°, the wrapper head assembly moves to a limit past the right end of the roll at 0.833 ft/sec (0.254 m/sec), to synchronize the start time of the following parts of the cycle during which the end surfaces of roll 10 are wrapped. During part F of the cycle, from 1500° to 1620°, the wrapper head assembly moves from its right limit to its left limit at 1.458 ft/sec (0.443 m/sec) and the swivel motor swivels the wrapper head assembly to about minus 135°. During part G of the cycle, from 1620° to 1790°, the wrapper head assembly dwells at the left limit; the swivel motor swivels to minus 90°; the tilt motor tilts the wrapper head assembly to plus 6°; and the #1 chordal sector of the left end is wrapped. During the H part of the cycle, from 1790° to 1910°, the wrapper head assembly moves from its left limit to its right limit; the swivel motor swivels to minus 45°; and the tilt motor tilts to plus 90°. During the I part of cycle, from 1910° to 2080°, the wrapper head assembly dwells at the right limit, the swivel motor swivels to minus 90°; the tilt motor tilts to plus 173°; and the #1 chordal sector of the right end is wrapped. The apparatus then repeats parts F through I until the complete side and end surfaces of the roll are covered, about seven cycles for a roll of the type mentioned. Each chordal sector is offset by about 50° from the previous chordal sector at that end.

While our invention has been shown and described with reference to particular embodiments thereof, those skilled in the art will understand that other variations in form and detail may be made without departing from the scope and spirit of our invention.

Having thus described our invention in sufficient detail to enable those skilled in the art to make and use it, we claim as new and desire to secure Letters Patent for:

1. Apparatus for winding and stretch wrapping rolls of web material, comprising:

a rotatable turret assembly;

a plurality of first means, mounted at circumferentially spaced locations on said turret assembly, for independently supporting and rotating at each of said locations a core on which said web material is to be, is being or has already been wound;

second means, positioned in proximity to said turret assembly, for applying a stretch wrap to a first roll while said first roll is supported and rotated by one of said first means; and third means, operatively connected to said turret assembly and said first and second means, for causing said first roll to be wound by one of said first means, for thereafter rotating said turret assembly to position said first roll at said second means and to position a core for winding of a second roll at another of said first means, and for thereafter (a) actuating said one of said first means and said second means to rotate and wrap said first roll and (b) actuating said another of said first means to wind said second roll while said first roll is being rotated by said one of said first means and wrapped by said second means.

2. Apparatus according to claim 1, wherein said third means comprises fourth means for signalling the speed of rotation of said first roll at said second means and fifth means operatively connected to said fourth means for controlling operation of said second means as a function of said speed.

3. Apparatus according to claim 2, wherein said second means comprises:

a roll of stretch wrap material having a longitudinal axis;

sixth means for supporting said roll of wrap material for rotation about said longitudinal axis;

seventh means for traversing said sixth means for supporting along a path substantially parallel to the axis of rotation of said first roll;

eighth means for moving said sixth means for supporting about a swivel axis substantially perpendicular to said path;

ninth means for moving said sixth means for supporting about a tilt axis substantially perpendicular to said swivel axis and to said longitudinal axis, whereby said wrap material can be applied in a spiral pattern around the cylindrical surface and across the ends of said first roll while said first roll is rotated and while said sixth means for supporting is moved along said path, about said swivel axis and about said tilt axis; and said third means comprises:

means for operating said seventh means at a speed proportional to said speed of rotation;

means for operating said eighth means at preselected positions along said path; and means for operating said ninth means at preselected positions along said path.

4. Apparatus according to claim 3, wherein said third means is progammable to account for different diameters of said first roll.

5. Apparatus according to claim 3, further comprising:

a swivel bearing having said swivel axis;

tenth means for mounting one race of said swivel bearing to said means for traversing;

a frame member;

eleventh means for mounting the other race of said swivel bearing to said frame member;

twelfth means for mounting said sixth means on said frame member to position said roll of wrap material along said swivel with said swivel axis passing roll of web material; and said eighth means being operatively connected to rotate said frame member on said swivel bearing about said swivel axis.

6. Apparatus according to claim 5, wherein the inner race of said swivel bearing is mounted to said means for traversing; the outer race of said swivel bearing is mounted to said frame member; and said means for moving about said swivel axis comprises a gear ring mounted to said frame member, a pinion gear engaged with said gear ring and means mounted on said means for traversing for rotating said pinion gear.

7. Apparatus according to claim 6, wherein said gear ring is mounted on said outer race.

8. A method for winding and stretch wrapping rolls of web material, comprising the steps of:

providing a rotatable turret assembly;

providing a plurality of first means, mounted at circumferentially spaced locations on said turret assembly, for independently supporting and rotating at each of said locations a core on which said web material is to be, is being or has already been wound;

providing second means, positioned in proximity to said turret assembly, for applying a stretch wrap to a first roll while said first roll is supported and rotated by one of said first means;

winding said first roll of such web material on one of said first means;

after said winding, rotating said turret assembly to position said first roll at said second means and to position a core for winding of a second roll on another of said first means;

after rotating said turret assembly, applying stretch wrap to said first roll while rotating said first roll with said one of said first means; and winding said second roll on said another of said first means while said first roll is being rotated by said one of said first means and wrapped by said second means.

9. A method according to claim 8 wherein said applying and winding steps occur at least partially simultaneously.

10. In an apparatus for stretch wrapping a body having a side surface extending between end surfaces, said apparatus being of the type including means for supporting and rotating said body about a first longitudinal axis thereof, a roll of stretch wrap material having a second longitudinal axis, means for supporting said roll of wrap material for rotation about said second longitudinal axis, means for traversing said means for supporting said roll of wrap material along a path substantially parallel to said first longitudinal axis, means for moving said means for supporting said roll of wrap material about a swivel axis substantially perpendicular to said path and means for moving said means for supporting said roll of wrap material about a tilt axis substantially perpendicular to said swivel axis and to said second longitudinal axis, whereby said stretch wrap material can be applied in a spiral pattern around said side surface and across said end surfaces while said body is rotated about said first longitudinal axis and said means for supporting said roll of wrap material is moved along said path, about said swivel axis and about said tilt axis, the improvement comprising:

a swivel bearing having said swivel axis;

first means for mounting one race of said swivel bearing to said means for traversing;

a frame member;

second means for mounting the other race of said swivel bearing to said frame member;

third means for mounting said means for supporting said roll of wrap material on said frame member to position said roll of wrap material along said swivel axis with said swivel axis passing through said roll of wrap material; and said means for moving about said swivel axis being operatively connected to rotate said frame member of said swivel bearing about said swivel axis.

11. Apparatus according to claim 10, wherein the inner race of said swivel bearing is mounted to said means for traversing; the outer race of said swivel bearing is mounted to said frame member; and said means for moving about said swivel axis comprises a gear ring mounted to said frame member, a pinion gear engaged with said gear ring and means mounted on said means for traversing for rotating said pinion gear.

12. Apparatus according to claim 11, wherein said gear ring is mounted on said outer race.

13. Apparatus according to claim 10, further comprising:

means for signalling the speed of rotation of said body; and means, operatively connected to said means for signalling, for controlling as a function of said speed of rotation the operation of said means for traversing, said means for moving about a swivel axis and said means for moving about a tilt axis.

14. Apparatus according to claim 13, wherein said means for controlling comprises:

means for operating said means for traversing at a speed proportional to said speed of rotation;

means for operating said means for moving about a swivel axis at preselected positions along said path; and means for operating said means for moving about a tilt axis at preselected positions along said path.

15. Apparatus according to claim 13, wherein said means for controlling are progammable to account for different diameters of such body.

* * * * *